US009889544B2

(12) United States Patent
Chern

(10) Patent No.: US 9,889,544 B2
(45) Date of Patent: Feb. 13, 2018

(54) RATCHET WRENCH

(71) Applicant: Shwu-Ruu Chern, Taichung (TW)

(72) Inventor: Shwu-Ruu Chern, Taichung (TW)

( * ) Notice: Subject to any disclaimer, the term of this patent is extended or adjusted under 35 U.S.C. 154(b) by 295 days.

(21) Appl. No.: 14/930,945

(22) Filed: Nov. 3, 2015

(65) Prior Publication Data

US 2017/0120424 A1 May 4, 2017

(51) Int. Cl.

| | |
|---|---|
| ***B25B 13/46*** | (2006.01) |
| ***B25B 13/10*** | (2006.01) |
| ***B25B 13/18*** | (2006.01) |

(52) U.S. Cl.

CPC ..... *B25B 13/463* (2013.01); *B25B 13/18* (2013.01)

(58) Field of Classification Search

CPC ..... B25B 13/463; B25B 13/18; B25B 13/10
See application file for complete search history.

(56) References Cited

U.S. PATENT DOCUMENTS 8,555,751 B1 * 10/2013 Chern ..... B25G 1/00 81/121.1

* cited by examiner

*Primary Examiner* — David B Thomas
(74) *Attorney, Agent, or Firm* — Pro-TECHTOR International Services; Ian Oglesby

(57) ABSTRACT

A ratchet wrench includes a head with a ratchet wheel rotatably received therein. A positioning unit is located in the head and is cooperated with a pawl which is engaged with the ratchet wheel. A collar is located in the head and has two notches defined in a peripheral wall of the collar. A curved groove is defined through the collar. Two toothed racks are formed along the groove. Two clamp members are located in the ratchet wheel which has two guide slots. Each clamp member has two guide rods which are located in the guide slot corresponding thereto. An engaging unit extends through the groove and is pivotably connected to a lever to securely position the clamp members when clamping an object. The two clamp members are adjusted to securely clamp the object by rotating the collar, and the object can be rotated by the ratchet wrench.

5 Claims, 9 Drawing Sheets

RATCHET WRENCH

BACKGROUND OF THE INVENTION

1. Fields of the Invention

The present invention relates to a ratchet wrench, and more particularly, to a ratchet wrench for easily adjusting the clamping size to fasten or loosen objects of different sizes.

2. Descriptions of Related Art

The conventional way to fasten or loosen an object such as a bolt, is to use a ratchet wrench which allows the user to continuously rotate the object without dismounting and re-mounting the wrench from the object frequently. The conventional ratchet wrench is usually cooperated with a socket which is mounted to the bolt head and the ratchet wrench is rotated to drive the socket to fasten or loosen the bolt. However, the socket has a fixed size so that when the bolts have different sizes, the user has to replace the sockets of different sizes. The multiple sockets are heavy and occupy space.

The present invention intends to provide a ratchet wrench which has the feature to adjust the clamping size such that the objects of different sizes can be fastened or loosened by using the same ratchet wrench without being cooperated with multiple sockets.

SUMMARY OF THE INVENTION

The present invention relates to a ratchet wrench and comprises a head and a handle, wherein the head has a through hole and a reception hole is defined in the inner periphery of the through hole. A positioning unit is located in the reception hole to bias a pawl in the head. The pawl has a projection extending from the rear side thereof, and multiple engaging teeth are formed on the front side thereof. The pawl is located in the head and connected with a switch. A collar is located in the through hole of the head and has a hole defined centrally therethrough. The diameter of the hole of the collar is smaller than that of the collar so as to form a ring-shaped portion enclosing the hole. A peripheral wall extends from the first side of the collar and two notches are defined in the peripheral wall. A curved groove is defined through the ring-shaped portion of the collar. Two toothed racks are formed along the groove. An engaging unit has a pin and a lever, wherein the pin has a hole 511 defined transversely therethrough. The pin extends through the groove from the first side of the collar, and the lever 52 is located on the second side of the collar and is pivotably connected to the pin. The pin has a hook.

A ratchet wheel is located in the collar and has ratchet teeth formed on the outer periphery thereof. The ratchet wheel has a room defined therein and two protrusions extend inward from the inner periphery of the room. A recess is defined in the first side of the ratchet wheel and the pin is inserted in the recess. Two curved guide slots are respectively defined in the first side of the ratchet wheel and the second side of the ratchet wheel. Two clamp members are located in the room of the ratchet wheel and each have two lugs extending from the outside thereof. The two lugs of each clamp member each have a guide rod extending from the facing side thereof. The guide rods of the two clamp members are located in the guide slots. A cover having an opening is connected to the head to restrict the ratchet wheel within the head.

Preferably, the positioning unit has a spring and a bead which is biased by the spring.

Preferably the collar has a flange extending outward from the peripheral wall extending from the first side of the collar. The collar is connected to the head.

Preferably, the collar has ridges extending from the outer periphery thereof.

Preferably, the two clamp members each are a V-shaped plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
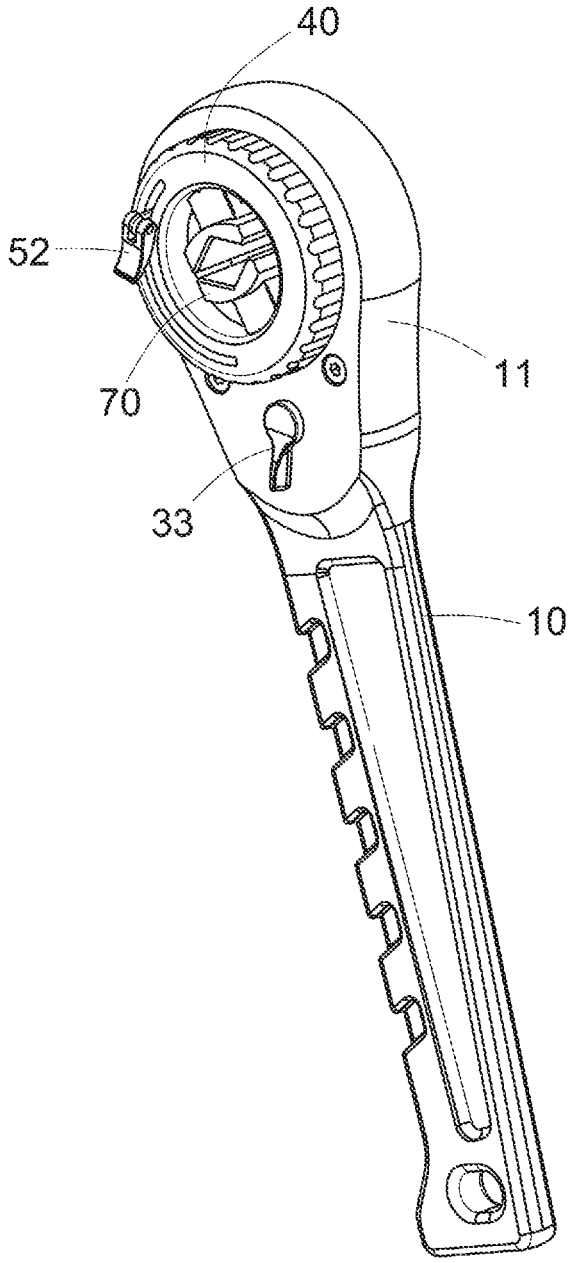
FIG. 1 is a perspective view to show the ratchet wrench of the present invention.
Figure 2:
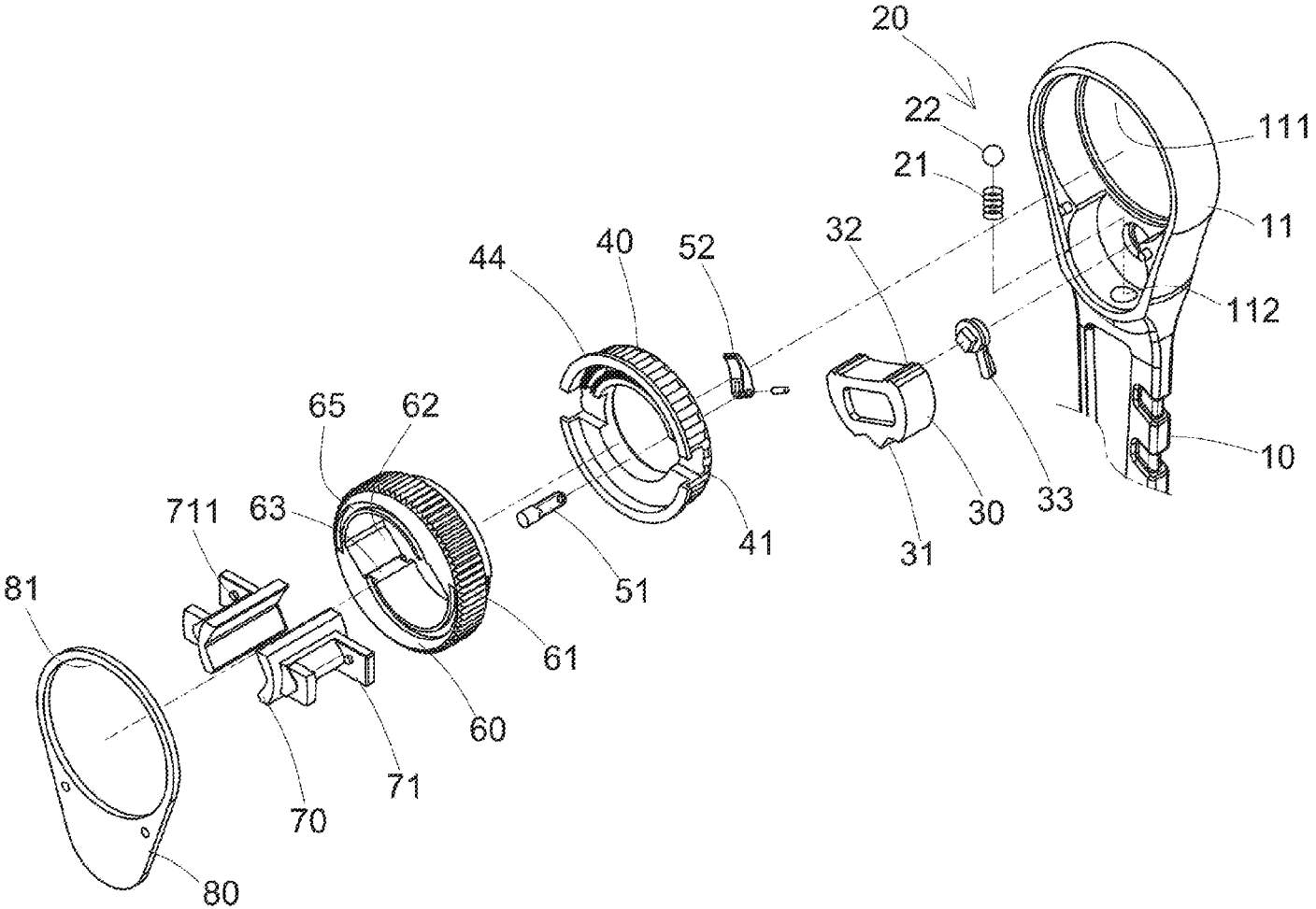
FIG. 2 is an exploded view of the ratchet wrench of the present invention.
Figure 3:
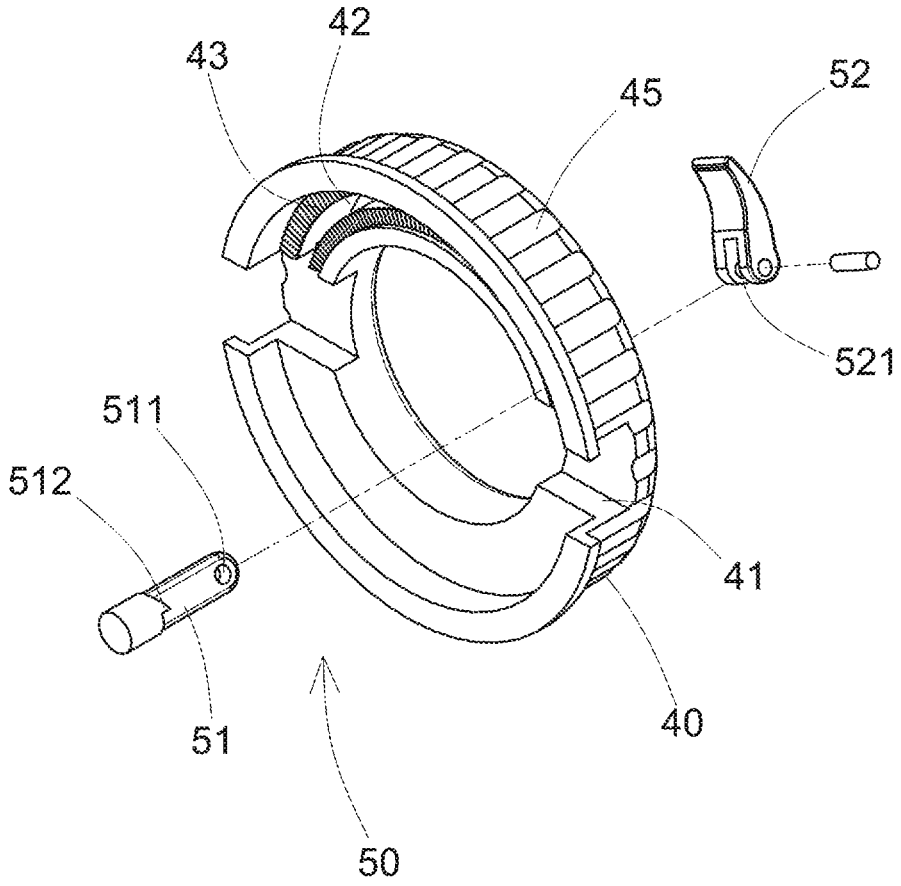
FIG. 3 is an exploded view of the collar and the engaging unit of the ratchet wrench of the present invention.

Referring to FIGS. 1 to 9, the ratchet wrench 10 of the present invention comprises a head 11 on one end of a handle, and the head 11 has a through hole 111 defined therethrough. A recess is defined in an inner periphery of the through hole 111 so as to receive a pawl 30 therein. A reception hole 112 is defined in the inner periphery of the recess and a positioning unit 20 is located in the reception hole 112. The positioning unit 20 has a spring 21 and a bead 22 which is biased by the spring 21.

The pawl 30 has a projection 31 extending from the rear side thereof, and multiple engaging teeth 32 are formed on the front side thereof and located at two ends of the front side. The pawl 30 is connected with a switch 33 to control the movement of the pawl 30.

A collar 40 is located in the through hole 111 of the head 11 and has a hole defined centrally therethrough. The diameter of the hole of the collar 40 is smaller than the diameter of the collar 40 so as to form a ring-shaped portion enclosing the hole. A peripheral wall extends from the first side of the collar 40, and two notches 41 are defined in the peripheral wall. A curved groove 42 is defined through the ring-shaped portion of the collar 40. Two toothed racks 43 are formed along the groove 42 and extend from the first side of the collar 40. The collar 40 has a flange 44 extending outward from the peripheral wall extending from the first side of the collar 40. By the flange 44, the collar 40 is connected to the head 11. The collar 40 has ridges 45 extending from the outer periphery thereof so that the user can easily hold and rotate the collar 40.

An engaging unit 50 has a pin 51 and a lever 52, wherein the pin 51 has a hole 511 defined transversely through the first end thereof. The first end of the pin 51 extends through the groove 42 from the first side of the collar 40. The lever 52 is located on the second side of the collar 40 and has a slot 521. The first end of the pin 51 is pivotably connected to slot 521 by extending a pivot through the slot 521 and the hole 511 of the pin 51. The pin 51 has a hook 512 formed on a lateral surface thereof and located close to the second end of the pin 51.

A ratchet wheel 60 is located in the collar 40 and has ratchet teeth 61 formed on the outer periphery thereof. The ratchet wheel 60 has a room 62 defined therein and two protrusions 63 extend inward from the inner periphery of the room 62. A recess 64 is defined in the first side of the ratchet wheel 60 and the pin 50 is inserted in the recess 64. Two curved guide slots 65 are respectively defined in the first side of the ratchet wheel 60 and the second side of the ratchet wheel 60.

Two clamp members 70 are located in the room 62 of the ratchet wheel 60 and each have two lugs 71 extending from an outside thereof. The two clamp members 70 each are a V-shaped plate. The two lugs 71 of each clamp member 70 each have a guide rod 711 extending from the facing side thereof. The guide rods 711 of the two clamp members 70 are located in the guide slots 65. A cover 80 having an opening 81 is connected to the head 11 to restrict the ratchet wheel 60 in the head 10.

Figure 4:
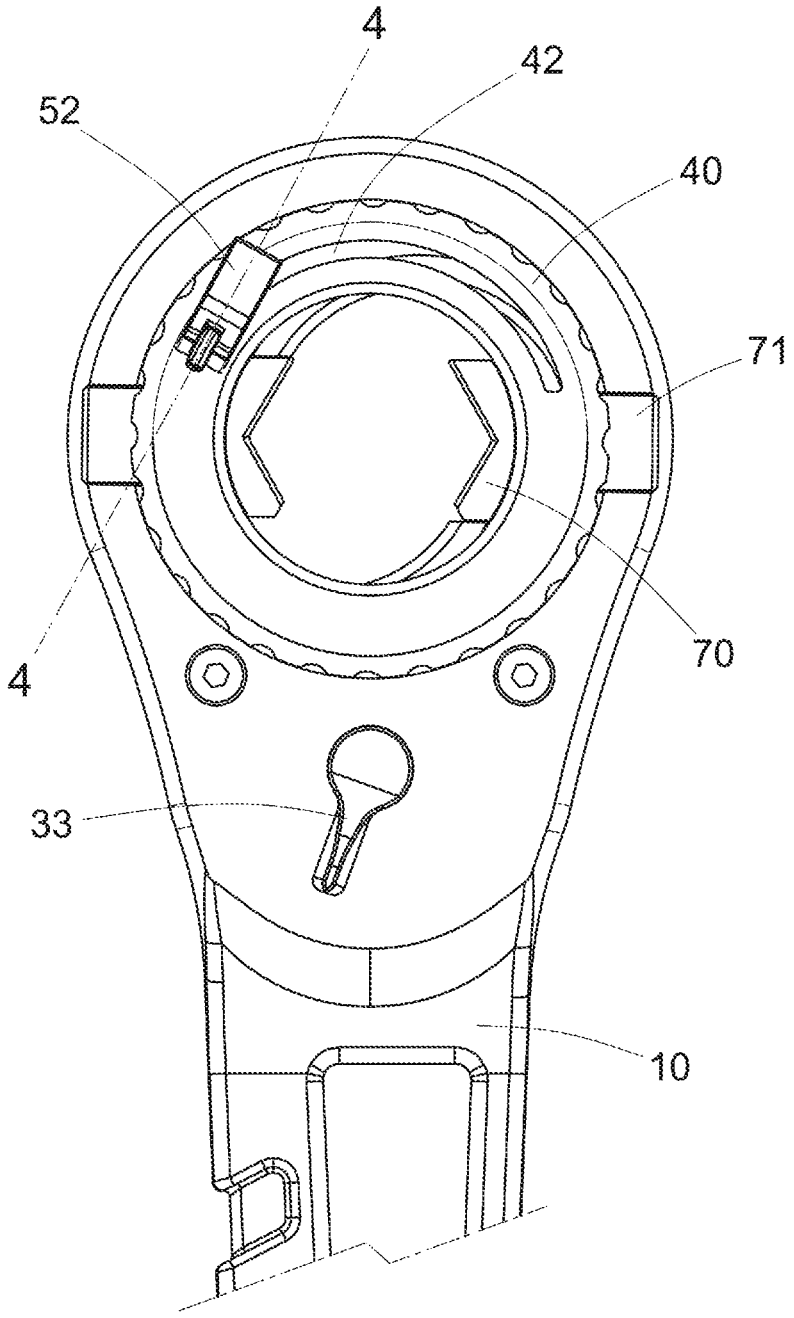
FIG. 4 is a top view of the ratchet wrench of the present invention.
Figure 5:
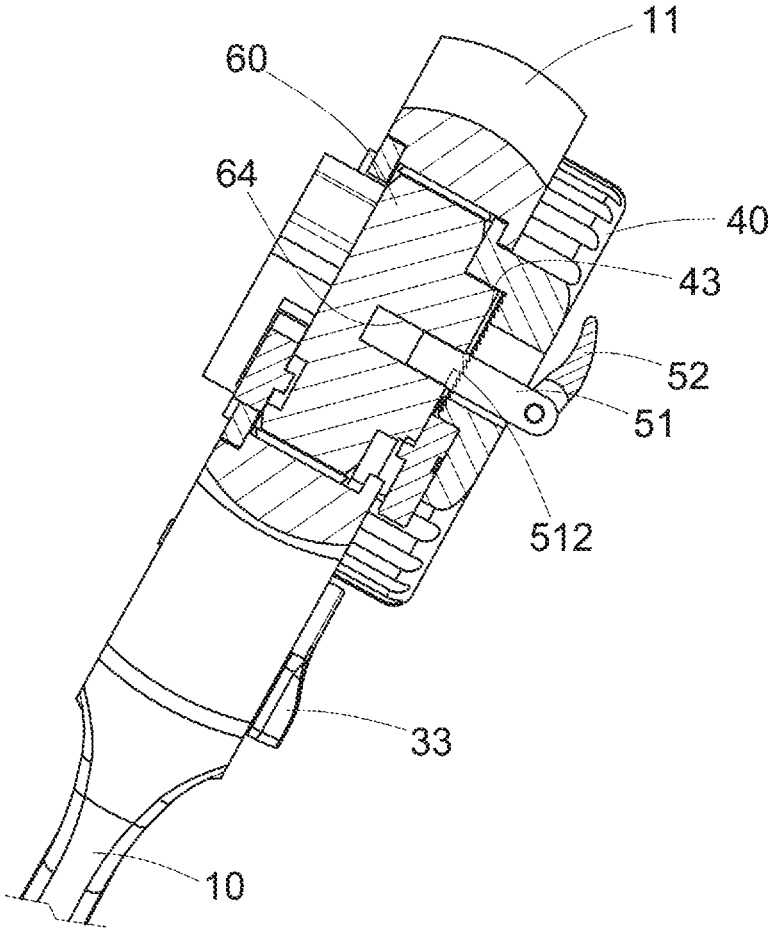
FIG. 5 is a cross sectional view, taken along line 4-4 of FIG. 4.
Figure 6:
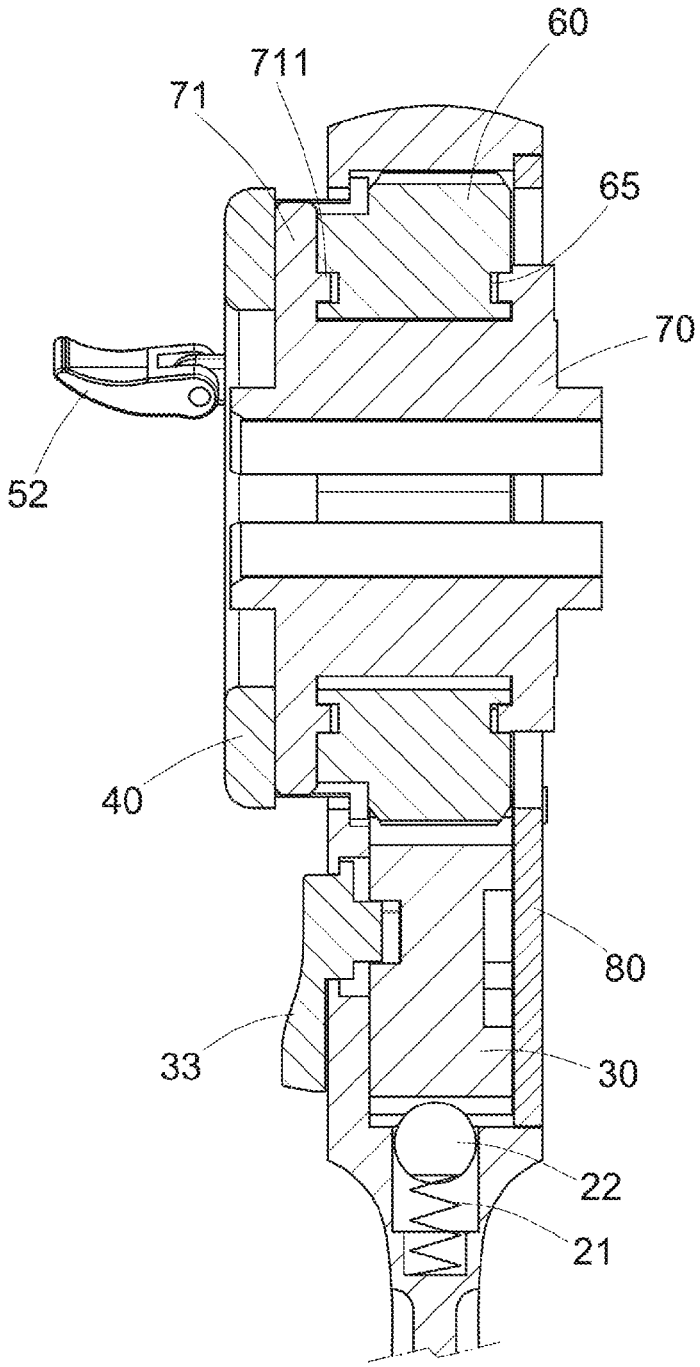
FIG. 6 is a cross sectional view of the ratchet wrench of the present invention.
Figure 7:
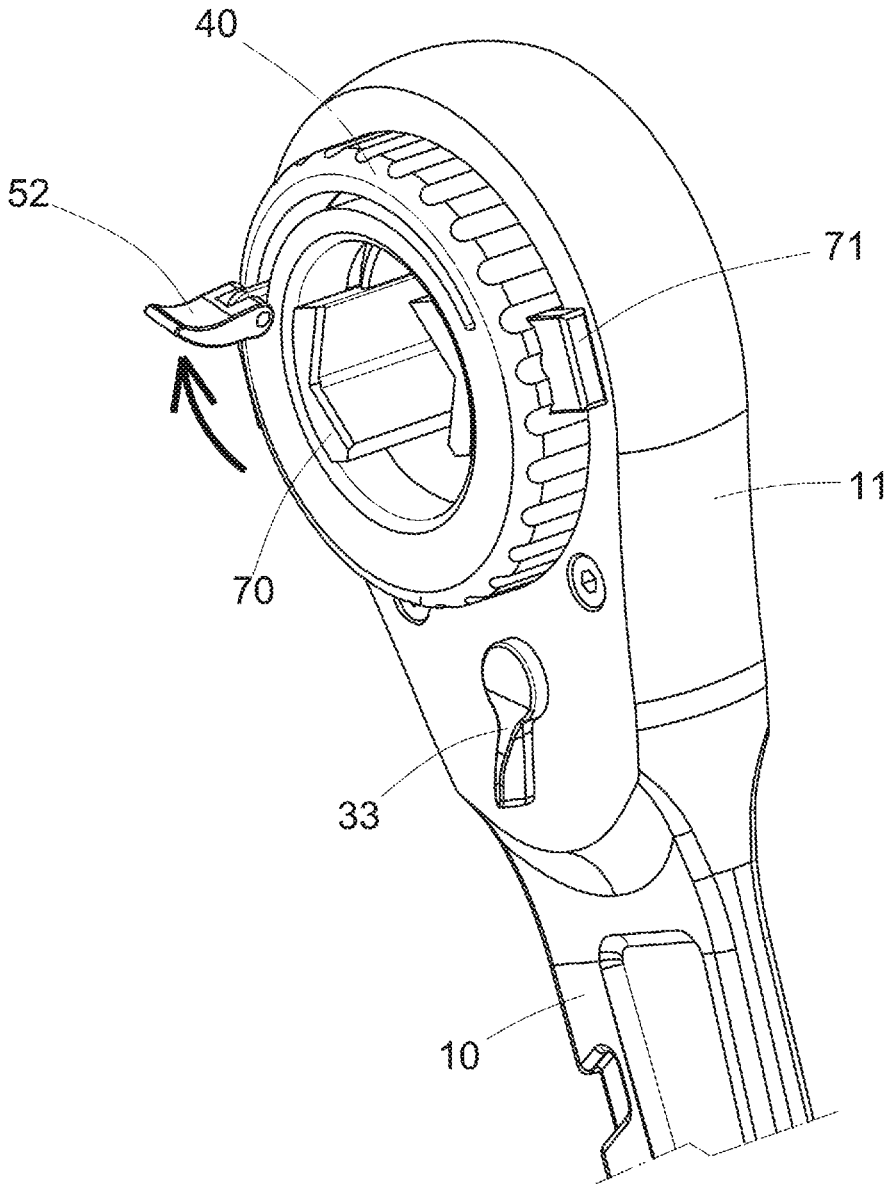
FIG. 7 shows that the engaging unit of the ratchet wrench of the unit of present invention is operated.
Figure 8:
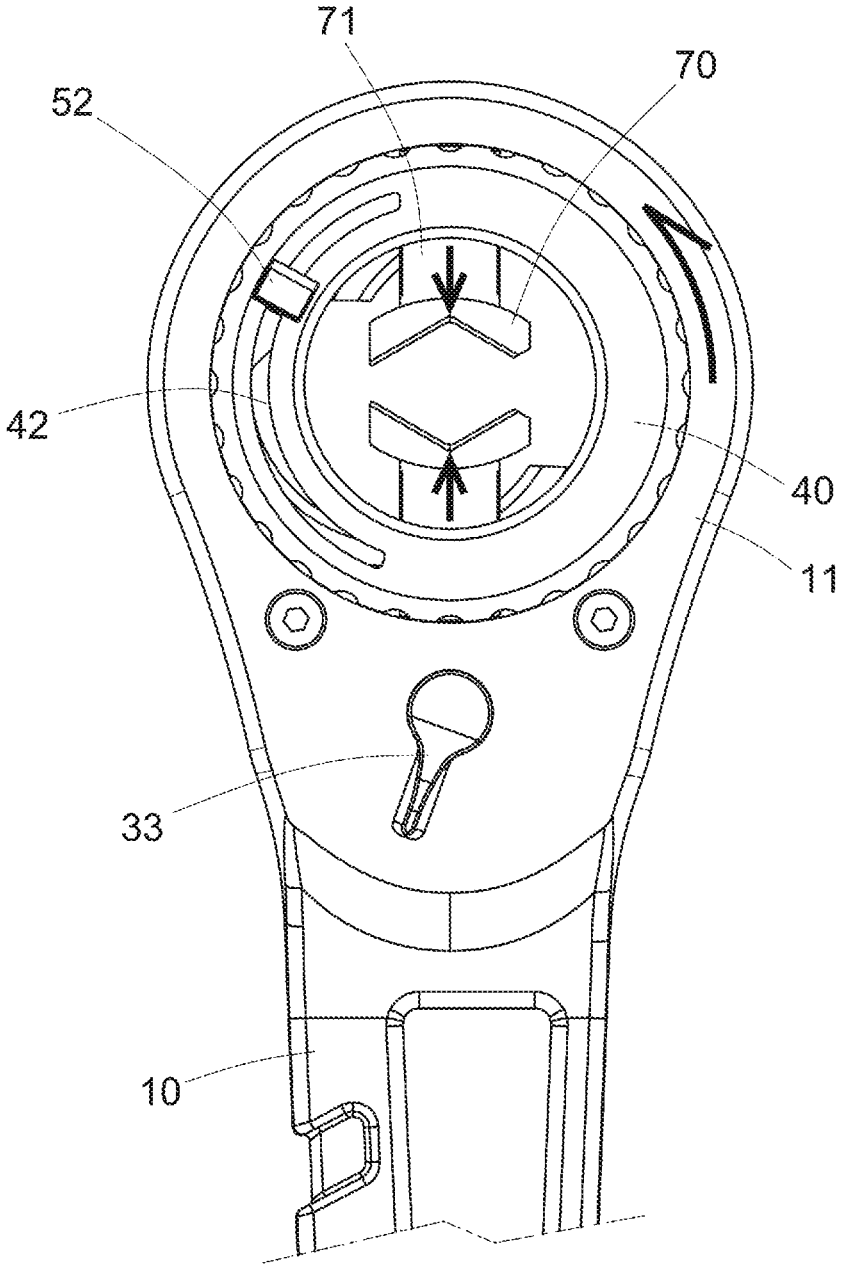
FIG. 8 shows that the clamp members are moved toward each other.
Figure 9:
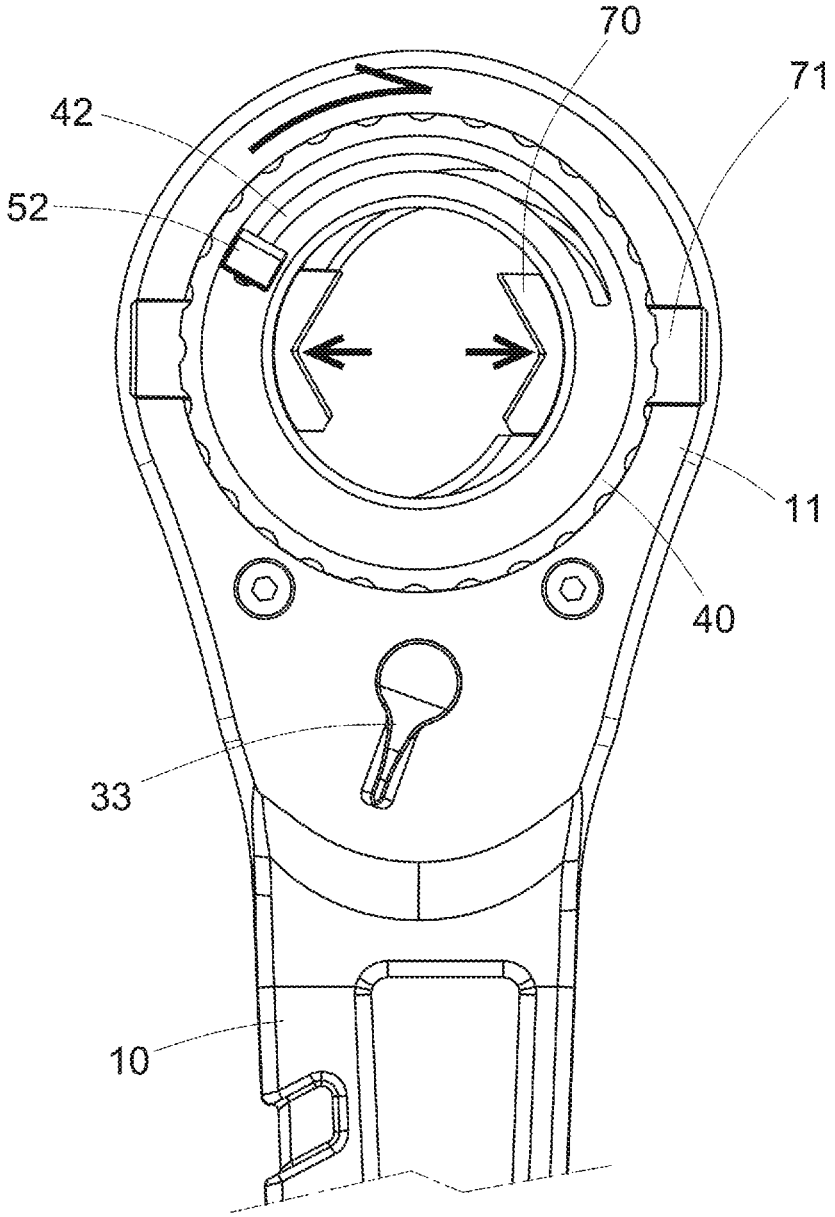
FIG. 9 shows that the clamp members are moved away from each other.

When the user wants to clamp an object with a rectangular head or a hexagonal head (not shown), the head of the object is put between the two clamp members 70 and the user rotates the collar 40. The two clamp members 70 move along the room 62 of the ratchet wheel 60 to a proper position as shown in FIGS. 7 to 9 so as to clamp the object. The lever 52 is then pivoted downward to lift the pin 51 upward such that the hook 512 is engaged with the toothed racks 43 of the collar 40 as shown in FIGS. 4 and 5. Therefore, the two clamp members 70 will not move to release the object, and the collar 40 is secured and cannot be rotated. The engaging teeth 32 of the pawl 30 are engaged with the ratchet teeth 61 of the ratchet wheel 60. The object can be rotated by rotating the handle to tighten or loosen the object. There will be not necessary to prepare the sockets of different sizes.

When the object is tightened or loosened, the lever 52 is pivoted upward to lower the pin 51, and the hook 512 is disengaged from the toothed racks 43 of the collar 40. The collar 40 is then rotatable and the two clamp members 70 are released from the object. The ratchet wrench 10 can be removed from the object.

While we have shown and described the embodiment in accordance with the present invention, it should be clear to those skilled in the art that further embodiments may be made without departing from the scope of the present invention.

What is claimed is:

1. A ratchet wrench comprising:

a head on one end of a handle, the head having a through hole defined therethrough, a reception hole defined in an inner periphery of the through hole, a positioning unit located in the reception hole;

a pawl having a projection extending from a rear side thereof, multiple engaging teeth formed on a front side thereof and located at two ends of the front side, the pawl located in the head and connected with a switch;

a collar located in the through hole of the head and having a hole defined centrally therethrough, a diameter of the hole of the collar being smaller than a diameter of the collar so as to form a ring-shaped portion enclosing the hole, a peripheral wall extending from a first side of the collar, two notches defined in the peripheral wall, a curved groove defined through the ring-shaped portion of the collar, two toothed racks formed along the groove;

an engaging unit having a pin and a lever, the pin having a hole defined transversely therethrough, the pin extending through the groove from the first side of the collar, the lever located on a second side of the collar and having a slot, the pin pivotably connected to slot by extending a pivot through the slot and the hole of the pin, the pin having a hook;

a ratchet wheel located in the collar and having ratchet teeth formed on an outer periphery thereof, the ratchet wheel having a room defined therein and two protrusions extending inward from an inner periphery of the room, a recess defined in a first side of the ratchet wheel and the pin inserted in the recess, two curved guide slots respectively defined in the first side of the ratchet wheel and a second side of the ratchet wheel;

two clamp members located in the room of the ratchet wheel and each having two lugs extending from an outside thereof, the two lugs of each clamp member each having a guide rod extending from a facing side thereof, the guide rods of the two clamp members located in the guide slots, and a cover connected to the head and having an opening, the ratchet wheel being restricted in the head by the cover.

2. The ratchet wrench as claimed in claim 1, wherein the positioning unit has a spring and a bead which is biased by the spring.

3. The ratchet wrench as claimed in claim 1, wherein the collar has a flange extending outward from the peripheral wall extending from the first side of the collar, the collar is connected to the head.

4. The ratchet wrench as claimed in claim 1, wherein the collar has ridges extending from an outer periphery thereof.

5. The ratchet wrench as claimed in claim 1, wherein the two clamp members each are a V-shaped plate.

* * * * *